US008840385B2

(12) United States Patent
Lipinski et al.

(10) Patent No.: US 8,840,385 B2
(45) Date of Patent: Sep. 23, 2014

(54) POSITIVE DISPLACEMENT FLUID PUMP

(75) Inventors: Wayne T. Lipinski, Essexville, MI (US); Joseph M. Ross, Greeneville, TN (US)

(73) Assignee: TI Group Automotive Systems, L.L.C., Auburn Hills, MI (US)

( * ) Notice: Subject to any disclaimer, the term of this patent is extended or adjusted under 35 U.S.C. 154(b) by 224 days.

(21) Appl. No.: 13/405,480

(22) Filed: Feb. 27, 2012

(65) Prior Publication Data

US 2012/0224991 A1 Sep. 6, 2012

Related U.S. Application Data

(60) Provisional application No. 61/449,013, filed on Mar. 3, 2011.

(51) Int. Cl.

| | |
|---|---|
| ***F03C 4/00*** | (2006.01) |
| ***F04C 2/00*** | (2006.01) |
| ***F04C 29/00*** | (2006.01) |
| ***F04C 2/08*** | (2006.01) |
| ***F04C 11/00*** | (2006.01) |
| ***F04C 2/10*** | (2006.01) |
| ***F04C 15/00*** | (2006.01) |

(52) U.S. Cl.

CPC ..... *F04C 2/102* (2013.01); *F04C 2/084* (2013.01); *F05C 2225/12* (2013.01); *F05C 2201/046* (2013.01); *F04C 11/008* (2013.01); *F04C 15/0069* (2013.01); *F04C 15/0073* (2013.01); *F04C 2210/1083* (2013.01)

USPC ..... 418/152; 418/69; 418/166; 418/171; 418/178; 418/179

(58) Field of Classification Search

USPC ..... 418/69, 152, 166, 171, 178–179

See application file for complete search history.

(56) References Cited

U.S. PATENT DOCUMENTS

| | | | | |
|---|---|---|---|---|
| 3,121,341 | A | 2/1964 | Hill | |
| 3,470,824 | A | 10/1969 | O'Connor et al. | |
| 4,012,180 | A | 3/1977 | Berkowitz et al. | |
| 4,976,595 | A * | 12/1990 | Taniguchi | 418/171 |
| 5,145,329 | A | 9/1992 | Zumbusch et al. | |

(Continued)

FOREIGN PATENT DOCUMENTS

| | | | |
|---|---|---|---|
| DE | 19961400 | A1 | 7/2001 |
| DE | 10334003 | A1 | 2/2004 |

(Continued)

OTHER PUBLICATIONS

Partial European Search Report dated Dec. 12, 2013, 3 pages.

(Continued)

*Primary Examiner* — Theresa Trieu

(74) *Attorney, Agent, or Firm* — Reising Ethington P.C.

(57) ABSTRACT

A fluid pump includes a motor, an inner gear rotor and an outer gear rotor. The inner gear rotor is driven for rotation about an axis by the motor and has a plurality of outwardly extending teeth. The outer gear rotor has a plurality of inwardly extending teeth that are engaged by the teeth of the inner gear rotor so that the outer gear rotor is driven for rotation about a second axis when the inner gear rotor rotates. At least one of the inner gear rotor and the outer gear rotor is formed from a plastic material.

18 Claims, 3 Drawing Sheets

(56) References Cited

U.S. PATENT DOCUMENTS

| | | | |
|---|---|---|---|
| 5,199,971 | A | 4/1993 | Akechi |
| 5,317,999 | A | 6/1994 | Kern et al. |
| 5,497,735 | A | 3/1996 | Kern et al. |
| 5,618,171 | A | 4/1997 | Von Behr et al. |
| 6,053,718 | A | 4/2000 | Schmidt et al. |
| 6,227,833 | B1 | 5/2001 | Froslev et al. |
| 6,264,449 | B1 | 7/2001 | Maute et al. |
| 6,604,922 | B1 | 8/2003 | Hache |
| 6,619,937 | B2 | 9/2003 | Friedrichsen et al. |
| 7,726,950 | B2 | 6/2010 | Hansen et al. |
| 7,726,959 | B2 | 6/2010 | Holtzapple et al. |
| 7,896,628 | B2 | 3/2011 | Sindt et al. |
| 2002/0192099 | A1 | 12/2002 | Patsch et al. |
| 2004/0037726 | A1 | 2/2004 | Burhenne et al. |
| 2006/0039815 | A1 | 2/2006 | Chertok et al. |
| 2006/0140810 | A1 | 6/2006 | Kameya et al. |
| 2008/0159884 | A1 | 7/2008 | Nakanishi et al. |
| 2008/0240966 | A1 | 10/2008 | Sevelsted et al. |
| 2009/0087563 | A1 | 4/2009 | Voegele et al. |
| 2010/0111722 | A1 | 5/2010 | Schneider et al. |
| 2012/0020820 | A1 | 1/2012 | Francini |
| 2012/0148426 | A1 | 6/2012 | Bodzak |

FOREIGN PATENT DOCUMENTS

| | | | |
|---|---|---|---|
| DE | 102006037177 | A1 | 2/2008 |
| DE | 102009028154 | A1 | 2/2011 |
| EP | 1369588 | A1 | 12/2003 |
| EP | 2182190 | A2 | 5/2010 |
| JP | 1147177 | | 6/1989 |
| JP | 2005188399 | | 7/2005 |
| WO | WO2005066502 | A1 | 7/2005 |
| WO | WO2010006575 | A2 | 1/2010 |
| WO | WO2010108959 | A2 | 9/2010 |

OTHER PUBLICATIONS

Extended European Search Report dated Mar. 12, 2014, 9 pages.

* cited by examiner

POSITIVE DISPLACEMENT FLUID PUMP

REFERENCE TO COPENDING APPLICATIONS

This application claims the benefit of U.S. Provisional Patent Application Ser. No. 61/449,013 filed Mar. 3, 2011, which is incorporated herein by reference in its entirety

TECHNICAL FIELD

The present disclosure relates generally to a fluid pump and more particularly to a positive displacement fluid pump.

BACKGROUND

Electric motor driven pumps may be used to pump various liquids. In some applications, like in automotive vehicles, electric motor driven pumps are used to pump fuel from a fuel tank to a combustion engine. In other applications, the pump may be used to pump additives such as those used to reduce nitrogen oxides present in exhaust gas from internal combustion engines and particularly diesel engines.

SUMMARY

A fluid pump includes a motor, an inner gear rotor and an outer gear rotor. The inner gear rotor is driven for rotation about an axis by the motor and has a plurality of outwardly extending teeth. The outer gear rotor has a plurality of inwardly extending teeth that are engaged by the teeth of the inner gear rotor so that the outer gear rotor is driven for rotation about a second axis when the inner gear rotor rotates. At least one of the inner gear rotor and the outer gear rotor is formed from a plastic material.

In at least some implementations, a fluid pump has a motor, a first pump body, a second pump body adjacent to the first pump body, an inner gear rotor, an outer gear rotor and a guide pin. The inner gear rotor is received between the first pump body and second pump body, driven for rotation about an axis by the motor and has a plurality of outwardly extending teeth. The outer gear rotor is received between the first pump body and second pump body, and has a plurality of inwardly extending teeth that are engaged by the teeth of the inner gear rotor so that the outer gear rotor is driven for rotation about a second axis when the inner gear rotor rotates. At least one of the inner gear rotor and the outer gear rotor is formed from a plastic material. The guide pin may be carried by at least one of the first pump body or the second pump body and defines an axis about which the inner gear rotor rotates. The guide pin is formed of metal when the inner gear rotor is formed from plastic, and when the inner gear rotor is formed of metal, the guide pin includes a bushing between the guide pin and the inner gear rotor.

A method of making components for a pump is also disclosed. The method includes forming a first pump body from a plastic material, molding a guide pin into the first pump body and machining a cavity into the first pump body using the guide pin as a reference for the location of the cavity. In this way, an outer gear rotor, when disposed at least partially within the cavity, is accurately located relative to the guide pin.

BRIEF DESCRIPTION OF THE DRAWINGS

The following detailed description of exemplary embodiments and best mode will be set forth with reference to the accompanying drawings, in which.

DETAILED DESCRIPTION OF PRESENTLY PREFERRED EMBODIMENTS

Figure 1:
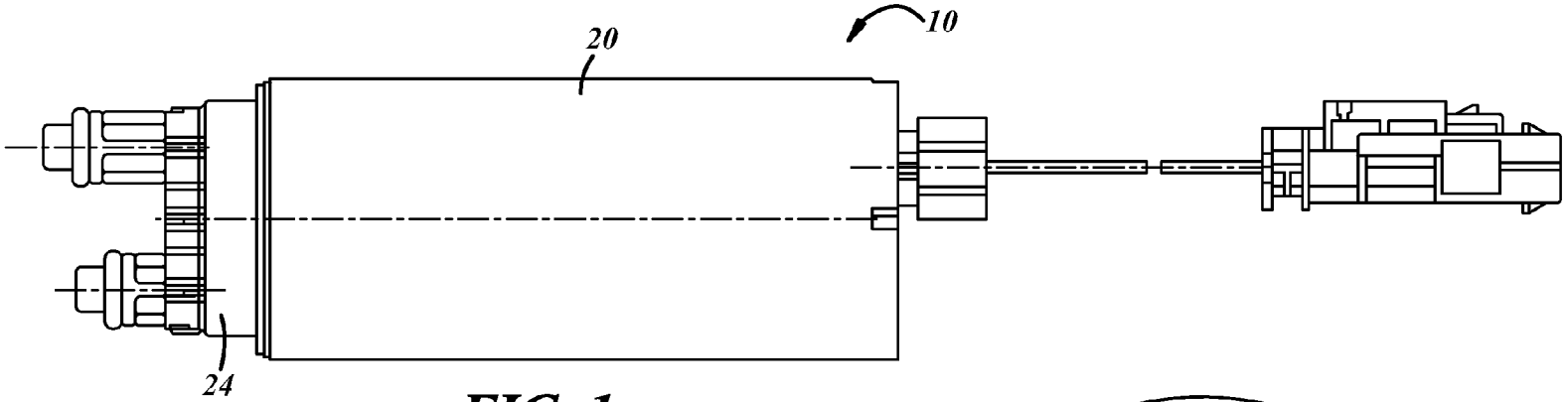
FIG. 1 is a side view of a fluid pump.
Figure 2:
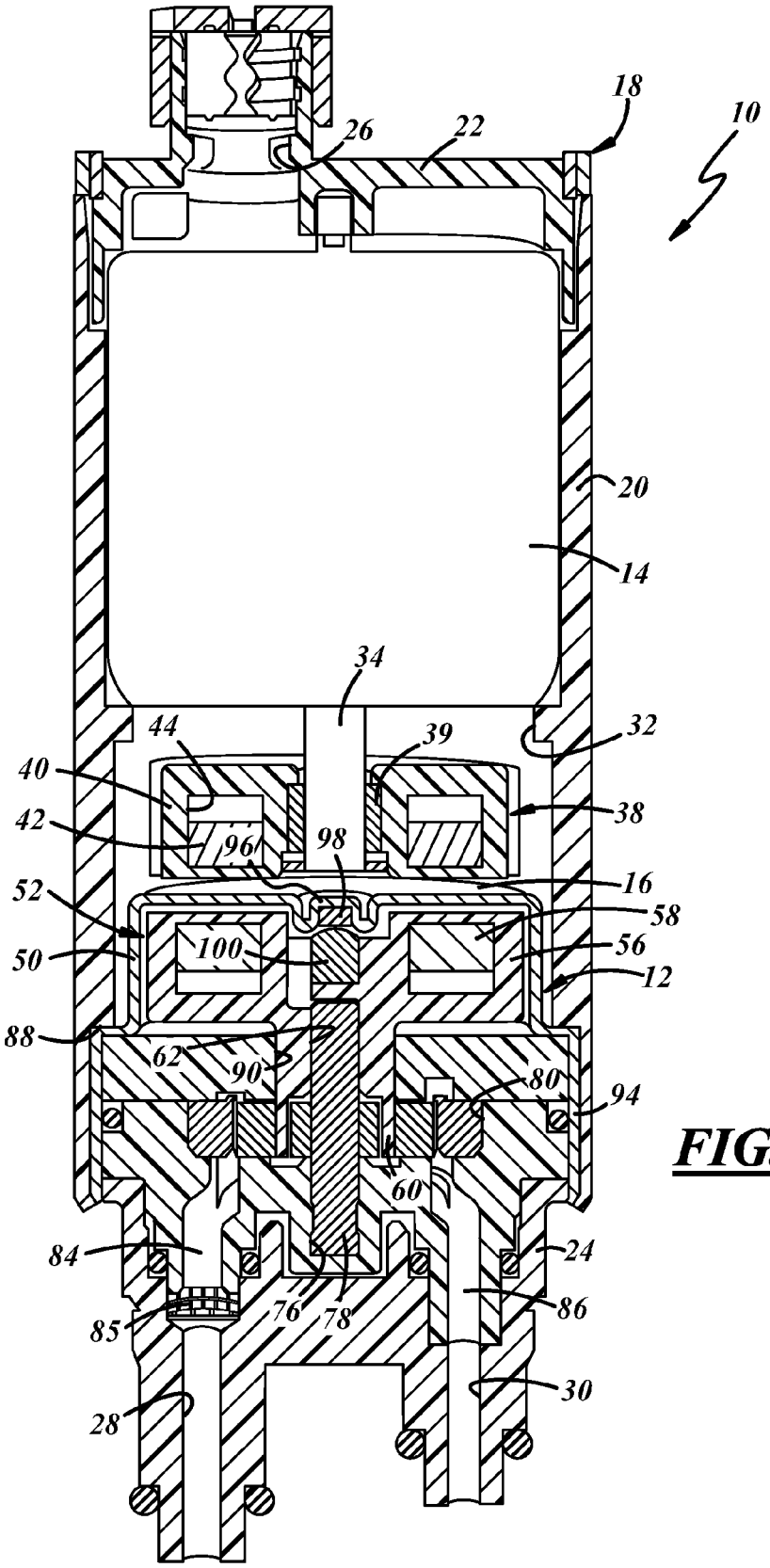
FIG. 2 is a sectional view of the fluid pump of FIG. 1.
Figure 3:
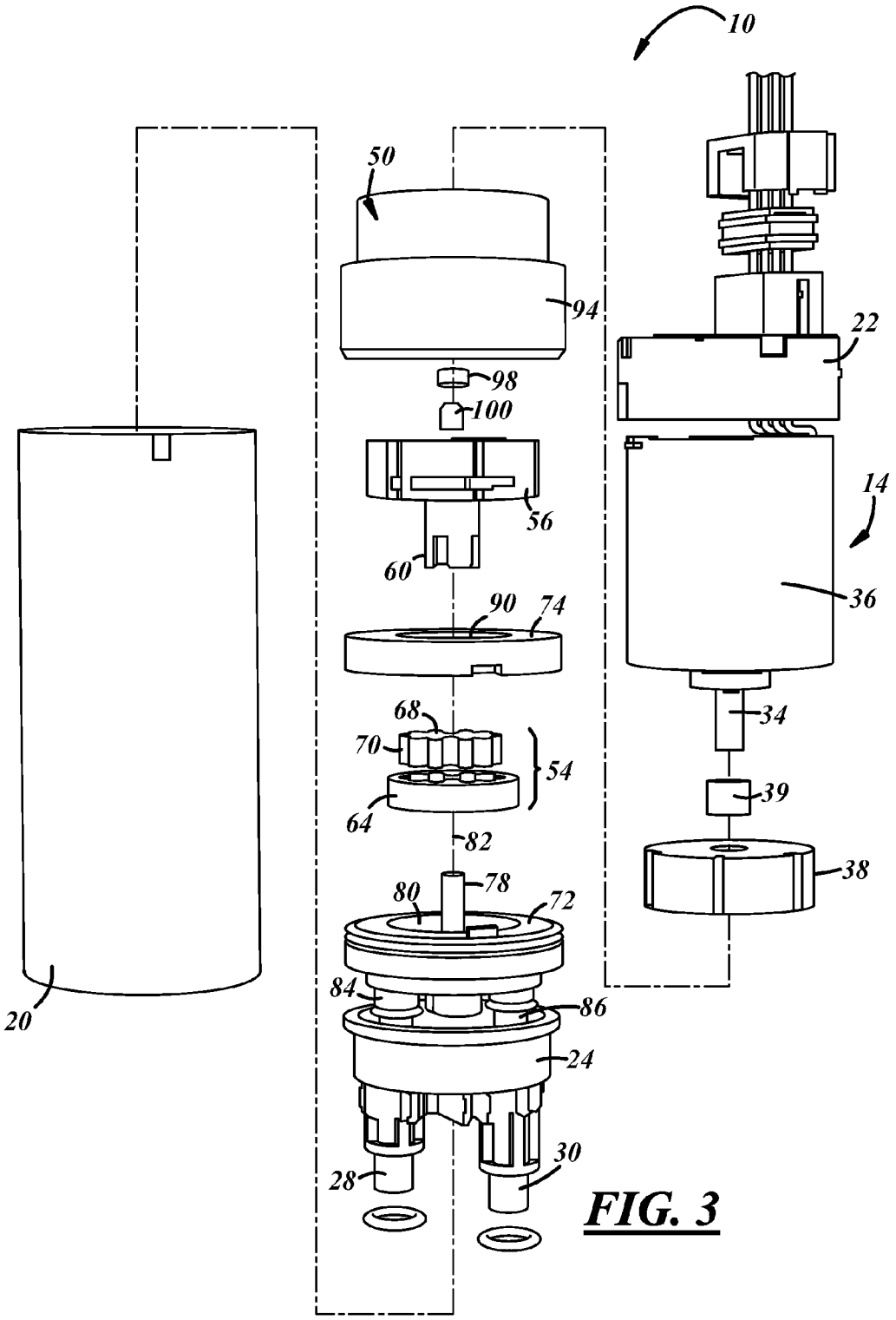
FIG. 3 is an exploded view of the fluid pump.

Referring in more detail to the drawings, FIGS. 1-3 illustrate a fluid pump 10 that has a positive displacement pump assembly 12 that may be driven for rotation by an electric motor 14. The pump 10 can used to pump any suitable liquid including, and for purposes of the rest of this description, selective catalytic reduction (SCR) reactants. SCR systems store an SCR reactant in a liquid or solid state. The SCR reactant may include a combination of urea —$(NH_2)_2CO$— and water. An example of a SCR reactant is ADBLUE, which is the registered trademark held by the German Association of Automobile Industry for an aqueous urea solution. The SCR reactant is delivered into a flow of exhaust gas downstream of an engine and upstream of one or more catalytic converters. A representative SCR system includes a selective discharge catalyst in an exhaust system, an injector to provide doses of the SCR reactant to the downstream catalyst, and an SCR reactant delivery system.

The fluid pump 10 may include the motor 14 coupled to the pump assembly 12 to drive the pump assembly. In the implementation show, the motor 14 drives the pump assembly 12 via a magnetic coupling. In this way, the motor 14 may be separated from the pump assembly 12 by a dividing wall 16, if desired, to maintain the motor separate from the fluid being pumped. The motor 14 and pump assembly 12 may, if desired, be physically connected together by a main housing 18. The main housing 18 may include a tubular shell 20 which may be formed from metal or plastic, a motor cover 22 (also plastic or metal) that may close an end of the shell 20 adjacent to the motor, and a pump cover 24 (also metal or plastic) that may close at least part of the end of the shell 20 adjacent to the pumping assembly 12. The motor cover 22 may include an opening 26 through which wires may pass to provide power to the motor 14. The pump cover 24 may include an inlet 28 through which liquid SCR reactant is extracted from the inside of a tank into the pump, and an outlet 30 through which pressurized liquid SCR reactant is discharged from the pump. The shell 20 may be crimped, rolled or otherwise formed around or adapted to retain the motor cover 22 and pump cover 24. The shell 20 may include or be provided with an internal stop, such as an indentation, rib 32 or other feature adapted to be engaged by or locate the motor 14 in a given position within the shell 20.

A motor assembly may include the motor 14 and an output shaft 34 that rotates with or is rotated by the motor 14. The motor 14 may be of any suitable construction including, for example without limitation, brush-type and brushless DC motors. For example, the motor 14 may provide about 30 m-Nm of torque at 13 Volts and 1.6 Amps at about 4,500 RPM, and may be an HC series motor available from Johnson Electric Industrial Manufactory Ltd., of Hong Kong. Another motor is provided by Minebea Co., Ltd., of Japan, under the model number BLDC36. The motor 14 may have a casing 36 surrounding its internal components and the motor casing 36 may be closely received in the shell 20. The output shaft 34 may have a drive feature or otherwise be coupled to a drive member 38. Drive features or couplings may include a set screw (not shown), a spline connection, mating non-circular drive features (such as a flat on the shaft 34 and in a bushing 39), and of course, other things may be used.

The drive member 38 may include a housing 40 coupled to the output shaft 34 and one or more magnetic field producing members such as the magnets 42 carried by the housing 40, circumferentially disposed around the shaft 34. The housing 40 may be formed of any suitable material, including various plastics. Because the housing 40 in this implementation is not exposed to the liquid being pumped, the housing 40 need not be formed of a material that is impervious to or otherwise compatible for use in contact with the liquid. The housing 40 may be retained or supported on the output shaft 34 by, for example, a press fit or a washer and clip, such as a spring clip coupled to the output shaft 34. As shown, the housing 40 includes one or more pockets 44 in which the magnets 42 are received. The pockets 44 could completely enclose the magnets 42 such as by overmolding the housing 40 on the magnets 42, or the pockets 44 could be open at one face so that, when the magnets are disposed within the pockets 44, one face of the magnets 42 is exposed along one face of the housing. In that arrangement, the face of the housing 40 may be disposed adjacent to the dividing wall 16. In general, the magnets 42 provide a magnetic field onto and through the dividing wall.

Of course, the magnet(s) 42 could be provided in any desired shape, configuration or arrangement including, but not limited to, a ring-shaped magnet, a flat disc magnet, or a plurality of magnetic segments or pieces spaced apart around the shaft 34. The drive member 38 may be constructed and composed of one or more rare-earth magnets carried by a stainless steel housing, or overmolded with phenolic or polyphenylene sulfide (PPS) resin. The magnets 42 may be composed, for example, of neodymium, iron, and boron ($Nd_2Fe_{14}B$). In another example, the drive member 38 may be commercially available from Magnetic Technologies, Ltd. of Oxford, Mass. An example coupling is an MTD-0.2 ASSY having 0.2 Nm of slip torque and constructed with an aluminum housing 40 and six magnets 42. The housing 40 and magnets 42 rotate with the output shaft 34 when electrical power is provided to the motor 14.

The pump assembly 12 may include a pump housing 50, a driven member 52 disposed within the housing 50 and a pumping element 54 coupled to and driven by the driven member 52. The driven member 52 may include a housing 56 and a member responsive to the magnetic field of the drive member 38, such as one or more magnets 58 or other member (s) that may be driven by the magnetic field provided from the magnets 42 of the drive member 38. The housing 56 may be constructed substantially similarly to the drive member housing 40 and the magnets 58 may likewise be of the same construction and material(s). The driven member housing 56 may include one or more fingers 60 adapted to be coupled to the pumping element 54 to couple the driven member 52 and pumping element 54 for co-rotation. The housing 56 may also include a central passage 62 in which part of a guide pin 78 or bearing may be received. Further, because the housing 56 may be exposed to the liquid being pumped, it may be formed of a different material than the drive member housing 40, if desired, and in particular, of a material suitable for use in the liquid being pumped. The magnets 58 may also be sealed within the housing 56 and isolated from the liquid, if desired or required in a particular application.

Figure 4:
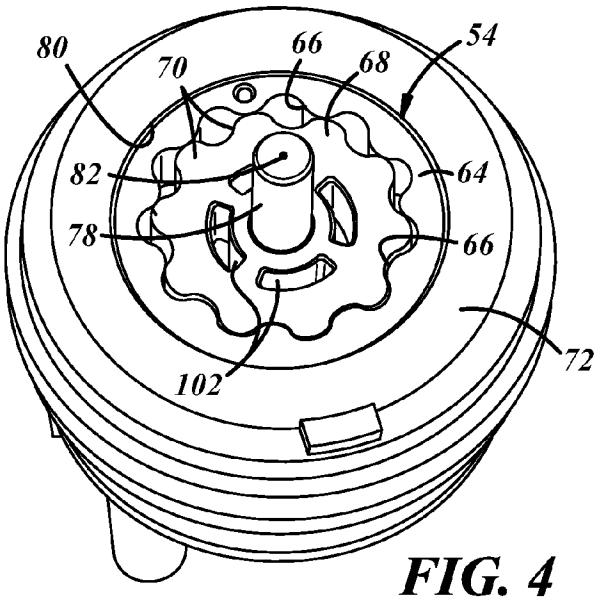
FIG. 4 is a perspective view of a pumping assembly of the fluid pump showing its pumping elements.

As shown in FIGS. 2-4, the pumping element 54 may be a positive displacement type pump including a pair of meshed gears, sometimes called a gerotor or gear rotor type pump. The pumping element 54, in the implementation shown, includes an outer gear rotor 64 which may be an annular ring gear having inwardly extending teeth 66 and an inner gear rotor 68 having outwardly extending teeth 70 that mesh with the outer ring gear's teeth 66. The outer and inner gear rotors 64, 68 are disposed between first and second pump bodies 72, 74.

The first pump body 72 may include a blind bore 76 in which is received an end of a shaft or guide pin 78 opposite the driven member housing 56. The first pump body 72, in the implementation shown, is trapped between the pump cover 24 and the second pump body 74. The first pump body 72 may also include a cavity 80 in which the outer gear rotor 64 is arranged (of course, the cavity could also be formed in the second pump body, or partially by both the first and second bodies). The cavity 80 may have an axis that is offset from the axis 82 of the guide pin 78 so that the axis of rotation of the outer gear rotor 64 is offset from the axis of rotation of the inner gear rotor 68. An inlet port 84 extends axially through the first pump body 72 to admit fluid at inlet pressure to the expanding chambers between the gear rotors 64, 68. The inlet port 84 is aligned with the inlet passage 28 in the pump cover 24, and, if desired, a filter or screen 85 may be disposed within one or both of the passages, or between them, to filter contaminants from the liquid being pumped. Similarly, an outlet port 86 is aligned with the outlet 30 of the pump cover 24 to permit fluid to be discharged from the pump assembly 12 therethrough.

The second pump body 74 may be received between the first pump body 72 and a flange or shoulder 88 of the shell 20. The second pump 74 body may overlie the gear rotors 64, 68, and may include a generally planar surface adjacent to the rotors to seal the pumping chambers and maintain the fluid in the pumping chambers until the fluid is moved to the outlet 86 whereupon it may be discharged from the pump assembly 12 under pressure. The second pump body 74 may include an opening 90 through which a portion of the driven member housing 56 extends to permit the driven member 52 and inner gear rotor 68 to be coupled together.

The pump housing 50 may couple together the driven member 52, pump bodies 72, 74, and the pump cover 24. The pump housing 50 may be generally cup-shaped with a closed end that may define all or part of the dividing wall 16, and a sidewall 94. The sidewall 94 may also be rolled around or otherwise secured to the pump cover 24 and crimped over a shoulder of the second pump body 74 to hold the pump bodies 72, 74 and pump cover 24 tightly together. Clearance may be provided between the pump housing 50 and the driven member 52 to permit the driven member 52 to rotate freely relative to the pump housing 50. The pump housing 50 may include a cavity or boss 96 in which a thrust disc 98 may be received. The thrust disc 98 may be engaged by the thrust pin 100 carried by the driven member housing 56 to provide a bearing surface for rotation of the driven member 52 and to space the driven member 52 from the pump housing 50 against the force of the magnets 42, 58 that tends to draw the driven member 52 toward the dividing wall 16. With the components coupled together by the pump housing 50, the pump assembly 12 may be a separately assembled unit to facilitate assembly with the motor 14 in the shell 20.

The inner gear rotor 68 may be rotatably coupled to the driven member 52 via the fingers 60 which may be received in slots or openings 102 (FIG. 4) formed in the inner gear rotor 68 to rotate about the same axis as the driven member 52, which may be coincident with the axis 82 of the guide pin 78. The inner gear rotor 68 may be formed from a metal or plastic material. Various plastics may be used, including thermosets (e.g. phenolic) and thermoplastics (e.g. PEEK or PPS), depending on the liquid being pumped. The material may include a lubricant such as Teflon or graphite in an amount of about 15% by weight, and a reinforcement material like carbon in an amount of about 30% by weight, and the material may have a flexular modulus greater than 20,000 MPa. In one currently preferred implementation, a phenolic resin is used to form the inner gear rotor and has a lubricant at 15% by weight and carbon at 30% by weight. When formed of plastic, the inner gear rotor may be molded into its final shape, or it may be molded and then machined to its final size and shape. When corrosion resistance is important, either a plastic or a corrosion resistant metal, like stainless steel, may be used. A stainless steel inner gear rotor may gall on a metal guide pin 78. A bushing could be used on the guide pin 78 to inhibit or prevent that from happening. A bushing could also be used, but might not be needed, between a plastic inner gear rotor and a metal guide pin. The guide pin 78 may be made from an austenitic steel or other material such as tungsten carbide with a hardness greater than 60 on the Rockwell C scale.

The outer gear rotor 64 may be rotatably driven by the inner gear rotor 68 to rotate the outer gear rotor about its axis, which may be offset from the axis of rotation of the inner gear rotor, as described above. The outer gear rotor 64 may be formed from a metal or plastic material. Various plastics may be used, including thermosets (for example, phenolic resins) and thermoplastics (for example, PEEK or PPS), as set forth with regard to the inner gear rotor. When formed of plastic, the outer gear rotor may be molded into its final shape, or it may be molded and then machined to its final size and shape. When corrosion resistance is important, either a plastic or a corrosion resistant metal, like stainless steel, may be used. In one currently preferred implementation, the outer gear rotor is formed from stainless steel, which may be sintered. The metal preferably is an austenitic stainless steel having 0.03% to 0.1% carbon, a density of at least 6.8 g/cc and a hardness greater than 60, and preferably greater than 70, on the Rockwell B scale. One example of such a metal is stainless steel 316N1, which also has relatively low elongation which may improve the ability to form the gear rotor to close production tolerances with little distortion. This same material may be used for the inner gear rotor if/when it is formed of metal. In at least certain presently preferred implementation, the gear rotors 64, 68 may include: 1) a plastic inner gear rotor and a plastic outer gear rotor; 2) a plastic inner gear rotor and a metal outer gear rotor; and 3) a metal inner gear rotor and a plastic outer gear rotor. These combinations of gear rotors 64, 68 may be formed to be durable and provide corrosion resistance.

At least certain corrosion resistant metals, like certain stainless steels, that may be used with more corrosive fluids may not be hard enough to meet certain durability standards (they may gall on the guide pin or between themselves). Hence, in some applications, use of inner and outer gear rotors that are both formed from corrosion resistant metals may not be satisfactory. In at least some implementations, the first pump body 72 may be formed of, or have its cavity 80 lined with a plastic material, at least when the outer gear rotor 64 is formed of metal. When the outer gear 64 is formed from a plastic material, the first pump body 72 may be formed of or have its cavity lined with a suitable metal.

In one implementation of a process of forming the pump assembly 12, the guide pin 78 may be insert molded into the first pump body 72. Then, the cavity 80 may be machined into the first pump body 72 using the guide pin 78 as a reference or locator. In this way, variations in the location of the guide pin 78 are accounted for to ensure a desired offset between the axis 82 of the guide pin 78 (which is the axis of rotation of the inner gear rotor) and the axis of the cavity 80 (which is the axis of rotation of the outer gear rotor). And a desired relationship between the inner gear rotor 68 and outer gear rotor 64 can be achieved throughout a production run of pumps. Of course, a multi-cavity mold could be used with one cavity formed to receive the guide pin 78 and a second cavity formed to receive the outer gear rotor 64. However, in at least certain implementations, there may be more variation between the location of the axes of the cavities in a multi-cavity mold as compared to machining the cavity using as the reference point the axis of the other cavity and the guide pin.

In one example process of forming the gear rotors, the inner gear rotor 68 may be molded from a plastic material and the outer gear rotor 64 may be a sintered stainless steel material. The inner gear rotor 68 can then be molded to its final shape or molded and machined to provide a desired size or shape to match with the outer gear 64, as desired. In one implementation, a clearance between the tips of the inner gear rotor teeth 70 and the outer gear rotor teeth 66 may be maintained between about 10 and 30 microns. The profile for the inner gear rotor and outer gear rotor may be maintained at a tolerance of 0.030 mm or less.

In operation, the motor 14 is energized with electrical power so as to rotate the output shaft 34 and the drive member 38 coupled to the shaft 34. Because of the magnetic attraction therebetween, rotation of the drive member 38 causes the driven member 52 to rotate about the guide pin 78 and within the pump housing 50. Because of the mechanical connection therebetween, rotation of the driven member 52 causes rotation of the inner gear rotor 68 which, via the intermeshed teeth 66, 70, rotates the outer gear rotor 64. Accordingly, operation of the motor 14 causes operation of the pumping assembly 12 through the wall 16 disposed therebetween. The magnetic coupling may permit the motor 14 to rotate even if the pump is frozen and unmovable, for example, when the SCR reactant is frozen therein. The pumping device 10 may be capable of any suitable output, for example without limitation, about 20 to 60 liters/hour at about 2 to 8 bar or more. The pumping device 10 may be carried by (e.g. on or in) the tank in any appropriate manner, or separate and remote from the tank. With the pump 10 operating through the wall 16 disposed between the motor 14 and the pump assembly 12, the motor 14 can be isolated from the liquid being pumped.

The dividing wall 16 across or through which the pump 10 operates, may be composed of a nonmagnetic material or a material that is not significantly magnetically susceptible, yet permits the magnetic field to permeate therethrough. For example, the wall across or through which the pump 10 operates may be composed of any suitable polymeric material, for example, polyamide or NYLON 6/6, or a metal such as a stainless steel that is sufficiently non-magnetic or is sufficiently magnetically permeable, for example austenitic or nickel containing stainless steel. In at least some implementations, the dividing wall 16 (which may be a portion of the tank wall as previously set forth) may be up to about 5 mm in total thickness, and in some implementations, the dividing wall may be between about 2 mm to 4 mm in total thickness.

The foregoing description is of preferred embodiments of the fluid pump; the inventions discussed herein are not limited to the specific embodiments shown. Various changes and modifications will become apparent to those skilled in the art and all such changes and modifications are intended to be within the scope and spirit of the present invention as defined in the following claims. By way of example without limitation, the motor could be directly mechanically coupled to the inner gear rotor without a magnetic coupling. In that case, a penetration through the dividing wall may be sealed, or no dividing wall may be needed at all, in at least certain implementations.

The invention claimed is:

1. A fluid pump, comprising:

a motor;

a first pump body;

a second pump body adjacent to the first pump body;

an inner gear rotor received between the first pump body and second pump body, driven for rotation about an axis by the motor and having a plurality of outwardly extending teeth;

an outer gear rotor received between the first pump body and second pump body, and having a plurality of inwardly extending teeth that are engaged by the teeth of the inner gear rotor so that the outer gear rotor is driven for rotation about a second axis when the inner gear rotor rotates;

the inner gear rotor is formed from a plastic material and the outer gear rotor is formed from a sintered austenitic stainless steel having 0.03% to 0.1% carbon, a density of at least 6.8g/cc and a hardness greater than 60 on the Rockwell B scale; and a guide pin carried by at least one of the first pump body or the second pump body and defining an axis about which the inner gear rotor rotates, and the guide pin is formed of metal.

2. The fluid pump of claim 1 which also includes a dividing wall separating the motor from the inner gear rotor and outer gear rotor, and a magnetic coupling that couples the motor to the inner gear rotor to rotate the inner gear rotor.

3. The fluid pump of claim 1 wherein the inner gear rotor is formed from a thermoplastic or a thermoset set material that includes a lubricant of at least about 15% by weight.

4. The fluid pump of claim 3 wherein the inner gear rotor is formed from a phenolic resin.

5. The fluid pump of claim 3 wherein the material of the inner gear rotor includes a reinforcement material of at least about 30% by weight.

6. The fluid pump of claim 3 wherein the material of the inner gear rotor has a flexural modulus greater than 20,000 MPa.

7. The fluid pump of claim 1 wherein the inner gear rotor is formed from a phenolic resin having a lubricant material of at least about 15% by weight and a reinforcement material of at least about a 30% by weight.

8. The fluid pump of claim 1 wherein a cavity is defined in at least one of the first pump body and second pump body, and wherein the outer gear rotor is received in the cavity and the cavity includes plastic material adjacent to the outer gear rotor.

9. The fluid pump of claim I wherein a clearance between tips of the inner gear rotor teeth and the outer gear rotor teeth is between 10 and 30 microns.

10. The fluid pump of claim 1 which also comprises a cavity machined into at least one of the first pump body and the second pump body having used the guide pin as a reference for the location of the cavity so that the outer gear when disposed at least partially within the cavity is accurately located relative to the guide pin.

11. The fluid pump of claim 1 which also comprises the inner gear rotor having been machined to provide a clearance of between 10 and 30 microns between tips of the inner gear rotor teeth and the outer gear rotor teeth.

12. A fluid pump, comprising:

an electric motor;

a first pump body;

a second pump body adjacent to the first pump body;

an inner gear rotor of a plastic material received between the first pump body and the second pump body, driven for rotation about an axis by the motor and having a plurality of outwardly extending teeth;

an outer gear rotor received between the first pump body and the second pump body, having a plurality of inwardly extending teeth that are engaged by the teeth of the inner gear rotor so that the outer gear rotor is driven to rotate about a second axis when the inner gear rotor is rotated by the electric motor; and the outer gear rotor is made of a sintered austenitic stainless steel having 0.03% to 0.1% carbon, a density of at least 6.8g/cc and a hardness greater than 60 on the Rockwell B scale.

13. The fluid pump of claim 12 wherein the plastic material of the inner gear rotor is a thermoplastic or a thermoset material that includes a lubricant of at least about 15% by weight.

14. The fluid pump of claim 13 wherein the lubricant comprises at least one of Teflon® or graphite.

15. The fluid pump of claim 12 wherein the plastic material of the inner gear rotor includes a reinforcement material of at least 30% by weight.

16. The fluid pump of claim 15 wherein the reinforcement material is a carbon material.

17. The fluid pump of claim 12 wherein a clearance between tips of the inner gear rotor teeth and the outer gear rotor teeth is between 10 and 30 microns.

18. The fluid pump of claim 12 wherein the inner gear rotor of plastic material has been machined to provide a clearance of between 10 and 30 microns between tips of the inner gear rotor teeth and the outer gear rotor teeth.

* * * * *

UNITED STATES PATENT AND TRADEMARK OFFICE

CERTIFICATE OF CORRECTION

PATENT NO. : 8,840,385 B2
APPLICATION NO. : 13/405480
DATED : September 23, 2014
INVENTOR(S) : Wayne T. Lipinski et al.

It is certified that error appears in the above-identified patent and that said Letters Patent is hereby corrected as shown below:

In the Claims,

Col 7, Line 31, after “thermoset” delete “set”.

Col 7, Line 44, after “about” insert --a--.

Signed and Sealed this
Sixth Day of January, 2015

Michelle K. Lee

Michelle K. Lee
*Deputy Director of the United States Patent and Trademark Office*